US005423304A

United States Patent [19]

Lawrence et al.

[11] Patent Number: 5,423,304

[45] Date of Patent: Jun. 13, 1995

[54] MECHANICALLY DRIVEN CENTRIFUGAL AIR COMPRESSOR WITH INTEGRAL PLASTIC PULLEY AND INTERNAL HELICAL RING GEAR

[75] Inventors: Thomas G. Lawrence, Clarkston; Gregg T. Black, Livonia, both of Mich.

[73] Assignee: Chrysler Corporation, Highland Park, Mich.

[21] Appl. No.: 333,085

[22] Filed: Oct. 31, 1994

[51] Int. Cl.[6] ..... F02B 33/40; F02B 39/04

[52] U.S. Cl. ..... 123/559.1; 415/122.1

[58] Field of Search ..... 123/559.1, 559.3; 415/122.1; 74/DIG. 10; 475/902

[56] References Cited

U.S. PATENT DOCUMENTS

| | | | |
|---|---|---|---|
| Re. 28,696 | 1/1976 | Rouverol | 74/462 |
| 1,479,993 | 1/1924 | Kirkham | 123/559.1 |
| 1,754,724 | 4/1930 | Mead . | |
| 1,852,569 | 4/1932 | Hobbs . | |
| 1,903,210 | 3/1933 | Carrier | 415/122.1 |
| 2,294,743 | 9/1942 | Funderburk . | |
| 2,973,894 | 3/1961 | Kimball et al. | 415/122.1 |
| 3,174,680 | 3/1965 | Young | 415/122.1 |
| 4,389,160 | 6/1983 | Onal | 415/122.1 |
| 5,058,546 | 10/1991 | Lawrence | 123/559.1 |
| 5,063,904 | 11/1991 | Winkelmann et al. | 123/559.1 |
| 5,085,199 | 2/1992 | Sado et al. | 123/559.1 |

*Primary Examiner*—Michael Koczo
*Attorney, Agent, or Firm*—Kenneth H. MacLean

[57] ABSTRACT

A mechanically driven centrifugal air compressor for an internal combustion engine has an impeller shaft supported in a compressor housing with journal bearings. A helical pinion gear is formed on one end of the impeller shaft and an impeller is attached to the other end. A thrust ring mounted on the impeller shaft near the impeller is sandwiched by a thrust bearing and the nearest journal bearing to axially locate the impeller shaft. An integral pulley and internal helical ring gear of molded plastic is rotatably supported on the compressor housing with the pulley engaged by a belt that is driven by a pulley of larger diameter fixed to an engine crankshaft. The ring gear meshes with the pinion gear to provide a high overdrive speed ratio at a low noise level in series with the belt and pulley drive from the engine crankshaft which provides a low overdrive speed ratio. The thrust bearing bears the axial load on the impeller shaft imposed by air pressure acting on the impeller and the lead of the helical pinion gear is set in a direction so that the gears impose an axial force on the impeller shaft that is opposite the impeller imposed axial force to substantially reduce the axial load borne by the thrust bearing.

9 Claims, 3 Drawing Sheets

MECHANICALLY DRIVEN CENTRIFUGAL AIR COMPRESSOR WITH INTEGRAL PLASTIC PULLEY AND INTERNAL HELICAL RING GEAR

TECHNICAL FIELD

This invention relates to a mechanically driven centrifugal air compressor for an internal combustion engine wherein the compressor has an impeller shaft that is supported with plain journal bearings and includes a gear train having a high overdrive speed ratio that is driven from the crankshaft of the engine with a belt and pulley arrangement having a low overdrive speed ratio.

BACKGROUND OF THE INVENTION

The most common form of centrifugal compressor that is used with internal combustion engines is a turbocharger wherein the impeller is driven by a turbine powered by the engine exhaust gases. This works well for a 4-cycle engine where the nominal combustion air is drawn into the cylinders on the piston downstroke. But in an externally scavenged 2-cycle engine there is no separate intake and exhaust stroke and instead there is a combined stroke wherein the combustion residuals must be pushed out of the cylinders with the fresh air for the next combustion event. In such an application, the air compressor is the sole source of combustion/-scavenge air and therefore at start up, there is insufficient exhaust gas flow to spin the turbine of a turbocharger with the result that there would be no combustion air for starting the engine. And thus a turbocharger is not suitable for such an application. Mechanically driving the compressor eliminates this start-up problem on a 2-cycle engine and can also be used in a 4-cycle engine. However, there is considerable difficulty in providing a suitable mechanical drive that will produce the necessary high compressor impeller speeds in a highly reliable manner and without objectionable noise levels. Moreover, it should be capable of being mass produced at a reasonable cost.

The mechanical drive between the engine crankshaft and the compressor impeller must provide a very high overdrive (output/input) speed ratio in order to drive the impeller at the extremely high speeds necessary to obtain acceptable operating efficiencies. For example, impeller speeds exceeding 100,000 RPM at peak engine speed are not uncommon and the overdrive speed ratio necessary to obtain same typically exceeds 15:1 and will of course vary with the relevant operating characteristics of both the engine and the compressor. Examples of mechanical drives that have been proposed for centrifugal air compressors are disclosed in U.S. Pat. Nos. 1,754,724; 1,852,569; 2,099,785; 2,294,743; and 5,063,904. As illustrated by these patents, such mechanical drives typically include various forms of gearing such as planetary gear drives and spur gear trains that may include an internal ring gear and pinion gear. Then there is also my U.S. Pat. No. 5,058,546 that discloses a mechanical drive employing a belt and pulley drive with a low overdrive speed ratio from the engine crankshaft in series with a friction drum and wheel providing a high overdrive speed ratio drive to the compressor impeller. The problems with an all gear drive include the noise of the gears and their attendant cost. And the gears, while providing a desirable positive type of drive, require a special mounting of the compressor gear train to include the engine crankshaft. On the other hand, a belt and pulley drive allows the centrifugal air compressor to be installed at various locations on the engine like other belt driven engine accessories. Moreover, the belt may be one that also drives one or more of the other engine accessories which is advantageous from both a cost standpoint and space allocation. But the belt and pulley drive must be limited to a low overdrive speed ratio of about 2:1 to prevent the belt from slipping on the smaller pulley at the high speed/load conditions encountered in such an application. As a result, a belt and pulley drive must be combined with a mechanical drive in some form that provides a high overdrive ratio that is highly reliable but yet does not produce objectionable noise levels and can be mass produced at a reasonable cost. In my above patent, such a high overdrive ratio is provided by a friction wheel and drum and while this has proven satisfactory and particularly with respect to noise, a geared overdrive has the potential for more load capacity and even greater reliability provided that the gear noise can be held to an acceptable level, the remainder of the compressor components are also highly reliable, and the cost is not prohibitive.

SUMMARY OF THE INVENTION

The present invention is an improvement over my above U.S. Pat. Nos. 5,058,546 and combines an internal helical ring gear and helical pinion gear drive providing a high overdrive speed ratio with a belt and pulley drive from the engine crankshaft that provides a low overdrive speed ratio through a pulley coupled to the internal helical ring gear. And the helical ring gear and the compressor pulley are integrally formed of molded plastic to reduce the gear noise and the cost of these parts. Moreover, the helix angle of the ring gear and pinion gear is utilized in the compressor to reduce the thrust bearing loads imposed by air pressure from impeller operation acting on the back of the impeller and a thrust ring on the impeller shaft is used to transfer these loads into a single thrust bearing mounted in the compressor housing.

In the compressor, the impeller is attached to one end of an impeller shaft that is supported in the compressor housing by two axially spaced plain journal bearings that are located adjacent the respective ends of the shaft. The thrust ring is mounted on the impeller shaft near the impeller and is sandwiched on one side by the thrust bearing and on an opposite side by both the compressor housing and the nearest journal bearing to axially locate the impeller shaft. The integrally joined plastic pulley and internal helical ring gear are rotatably supported with anti-friction bearings on the compressor housing and the pulley is engaged by a belt that is driven by a pulley of larger diameter attached to an engine crankshaft. The ring gear meshes with the pinion gear which is formed integral with the other end of the impeller shaft and the gears provide a high overdrive speed ratio in series with the belt and pulley drive from the engine crankshaft which provides a low overdrive speed ratio.

The thrust bearing bears the axial load on the impeller shaft imposed by air pressure acting on the back of the impeller from impeller operation and the lead of the helical pinion gear is set in a direction so that the gears impose an axial tension force on the impeller shaft with their helix angle that is opposite the impeller imposed axial tension force to substantially reduce the impeller imposed axial load borne by the thrust bearing. Lubrication of the critical surfaces in the compressor is provided by engine oil which is delivered under pressure to a space surrounding the impeller shaft. The oil passes through the journal bearings to lubricate and cool the latter and with oil from the journal bearing near the pinion gear then directed to lubricate and cool the pinion gear and the ring gear. The anti-friction bearings supporting the integral plastic ring gear and pulley are of the ball type and are permanently lubricated and sealed so that they do not require any oil delivery. A spacer sleeve received on the impeller shaft provides for spacing of the impeller on the impeller shaft, attaching of the impeller and the thrust ring to the impeller shaft by clamping action, and dual oil sealing with a lip seal and a split expansible ring seal.

It is therefore an object of the present invention to provide a new and improved mechanically driven centrifugal air compressor for an internal combustion engine.

Another object is to provide a centrifugal air compressor having a mechanical overdrive that is reliable, does not produce objectionable noise levels and can be mass produced at reasonable cost.

Another object is to provide a centrifugal air compressor having a mechanical overdrive wherein a pulley driven internal helical ring gear meshes with a helical pinion gear that drives the compressor impeller, the helical ring gear is formed integral with the pulley and of plastic to reduce the gear noise, and the lead of the pinion gear is set so that the meshing ring gear and pinion gear impose an axial load on the impeller shaft that is opposite to and reduces the axial load imposed thereon by air pressure acting on the impeller.

These and other objects, advantages and features of the present invention will become more apparent from the following description with reference to the accompanying drawings wherein:

DETAILED DESCRIPTION OF THE DRAWINGS

Figure 1:
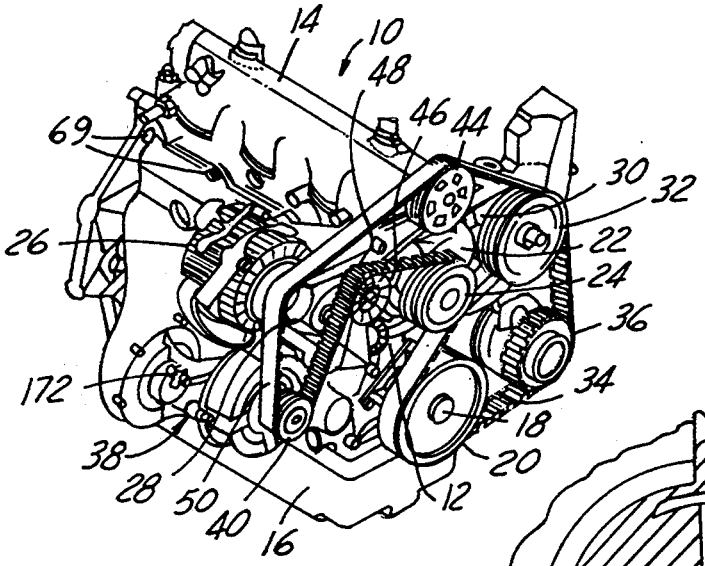
FIG. 1 is a perspective view of an internal combustion engine including a preferred embodiment of the mechanically driven centrifugal air compressor according to the present invention.
Figure 3:
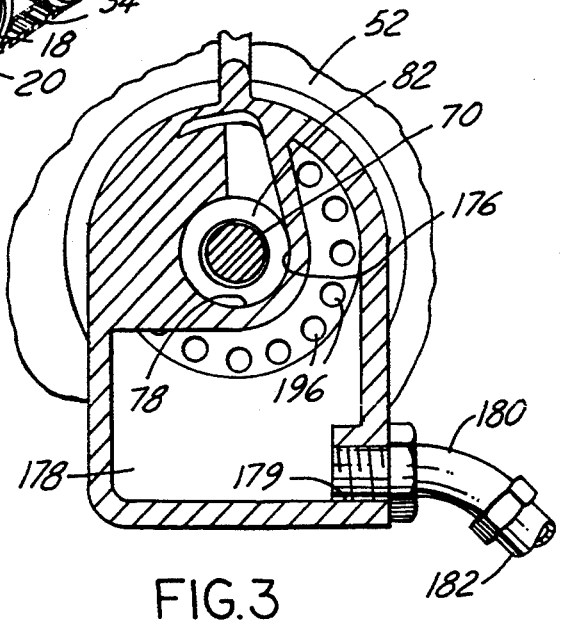
FIG. 3 is an enlarged view taken along the line 3—3 in FIG. 2 when looking in the direction of the arrows.

Referring to FIG. 1, there is illustrated an internal combustion engine 10 that includes a block 12, a cylinder head 14, an oil pan 16, and a crankshaft 18 that has an end extending from the front of the engine block. A pulley 20 is attached to this end of the crankshaft to drive various engine accessories that are mounted on the engine and include a water pump 22 having a pulley 24, an alternator 26 having a pulley 28, a power steering pump 30 having a pulley 32, an air conditioning compressor 34 having a pulley 36, and a centrifugal air compressor 38 having a pulley 40.

The above pulleys are part of an accessory drive system that further includes an idler pulley 44 and a tensioning pulley 46 which are also mounted on the engine. The tensioning pulley 46 is mounted on the engine with an adjustable mounting device 48 of conventional design that provides for adjusting the tension in a drive belt 50 that is received by the pulleys and transmits drive from the crankshaft pulley to the above accessories. In this accessory belt and pulley drive system, the engine crankshaft pulley 20 has a relatively large pitch diameter compared to all the other pulleys but particularly with respect to the accessory pulleys to allow the latter pulleys to have large enough pitch diameters to avoid belt slip at high speed/load conditions. The drive belt 50 is a polyvee type flat belt with a plurality of integral parallel V-shaped belt sections on its drive side and the accessory pulleys and the idler pulley have a corresponding number of parallel V-shaped grooves that receive these V-belt sections. The tensioning pulley 46 on the other hand has a cylindrical surface that is engaged by the plain back side of the belt to provide for belt tensioning in a conventional manner.

Referring to FIGS. 1–6, the centrifugal air compressor 38 forces fresh air to the intake ports in the cylinder head 14 and includes an aluminum housing 52 having a circular front end 54 and rear 56 that face in opposite directions and parallel each other. A cylindrical shaped end cover 58 made of aluminum is attached with bolts 60 to the front housing end 54 and an integral scroll section 62 and intake manifold section 64 and generally designated as 66 and also made of aluminum is attached with bolts 68 to the rear housing end 56. The scroll/intake manifold 66 and thereby the complete centrifugal air compressor 38 is attached at the exit end of the intake manifold 64 to the cylinder head 14 with bolts 69 at a location on the head where the manifold exit aligns with the intake ports in the head.

A steel impeller shaft 70 having an integral helical gear 72 formed at one end and axially spaced front and rear journals 74 and 76 of equal diameter is supported in a bore 78 in the housing 52 with front and rear plain journal bearings 80 and 82 that receive the respective journals. The journal bearings are made of bronze and are press fitted in the bore 78. The shaft journals extend radially from the main body of the shaft and together with their bearings are located at the opposite ends of the bore 78 with their outboard ends flush with the respective ends of this bore. The front journal 74 is located on the shaft close to the pinion gear 72 and the outboard end of its journal bearing 80 is mounted flush with a planar surface 84 on the front housing end 54 that is at right angles to the bore 78 and shaft 70. The outboard end of the rear journal bearing 82 is mounted flush with a flat machined surface 86 in the housing that is also at right angles to the bore 78 and shaft 70. Tight control of the radial runout between the pinion gear and the bearing journals is provided by grinding the pinion directly on the shaft rather than as separate part.

A hardened and ground steel thrust ring 88 is received on the impeller shaft outward of the rear journal 76 and contacts on one side with both the outboard end of the rear journal bearing 82 and an annular portion of the machined housing surface 86 about this end of the bore 78. A bronze thrust bearing 90 having a central opening 92 is received by the shaft 70 and is mounted at an outer cylindrical surface 94 thereof in a counterbore 96 in the rear housing end 56 that is co-axial with the bore 78. The thrust bearing 90 contacts on one side at a flat annular area 91 adjacent its center opening with the thrust ring 88. The other side of the thrust bearing has a central dish shaped cavity 98 and contacts outward thereof at a flat annular surface 100 with a metal seal retainer 102 having a central bore 103. The seal retainer 102 is received by the impeller shaft and supports an elastomeric lip seal 104 and is also mounted in the counterbore 96. The bearing retainer is forcibly retained therein together with the thrust bearing by a snap ring 105 wherein the thrust bearing is tightly held against the bottom of this counterbore and both it and the bearing retainer are thus prevented from rotating. Sealing is provided between the housing and the bearing retainer by an elastomeric O-ring 106.

A shaft spacer sleeve 108 made of steel and providing an impeller spacing function, an impeller and thrust ring attaching clamping function and a dual sealing function is received by the shaft, extends through the seal retainer 102 and the thrust bearing 90 and seats on the thrust ring 88. The sleeve 108 has a cylindrical outer surface 109 that is hardened and ground and is contacted by the lip seal 104. The sleeve 108 also has a cylindrical land 110 of larger diameter than the cylindrical surface 109 at its impeller end that is closely received in the bore 103 of the seal retainer. An expansible split seal ring 112 made of cast iron or other suitable bearing grade resilient metal is mounted in a groove in the sleeve land 110 and expands outwardly to be held stationary by the retainer bore 103. The seal ring 112 provides additional sealing between the sleeve and the seal retainer wherein the sleeve rotates relative to the seal ring with tight sealing provided at the outer diameter of the seal ring where it contacts the retainer bore and sealing provided in a labyrinth manner at the stationary inner diameter and sides of the seal ring in the rotating sleeve groove.

An aluminum impeller 114 with alternating long and short helical vanes 116 and 117 of conventional design has a central bore by which it is received on the end of the impeller shaft outboard of the shaft spacer sleeve 108. This end of the shaft is threaded to take a nut 118 that is screwed thereon and tightened to securely pinch or clamp the impeller, shaft spacer sleeve, and the thrust ring against a shoulder 120 ground on the end of the rear shaft journal 76. By this pinching or clamping action, the impeller, the sleeve and the thrust ring are all effectively coupled or attached to rotate with the impeller shaft whose axial position is maintained by the thrust ring 88 operating between the thrust bearing 90 and the rear journal bearing 82 and machined surface 86. The control of the axial positioning of the impeller shaft in the compressor housing 52 is made relatively simple in the manufacture of the compressor by controlling to very close tolerances only the depth to which the surface 86 is machined and the thickness of the thrust ring 88.

The impeller 114 is received in the scroll section 62 which has a circular air intake opening 122 and a scroll cavity 124 of conventional design. The air intake opening opens to the impeller at the entrance to the vanes and the scroll cavity is open to the tips of the vanes and connects with the intake manifold section 64. The impeller operates in a conventional manner on high speed rotation to draw in air through the intake opening and deliver same by centrifugal force into the scroll cavity where it is then directed to the intake manifold section and thence by the latter to the engine intake ports. In such centrifugal pumping operation, air pressure resulting from impeller operation acts on the back of the impeller imposing an axial tension load on the impeller shaft that must be resisted by the thrust bearing 90 to hold the impeller shaft in place in the compressor housing.

The thrust ring 88 is located nearest the end of the impeller shaft 70 closest to the impeller to minimize the effect of thermal growth of the shaft on the axial positioning thereof with the thrust ring. Thermal expansion of the shaft causes it to grow in length on both sides of the thrust ring because the thrust ring can not move axially within the housing. By keeping the thrust ring as close as possible to the impeller, the effect of thermal growth is limited and higher compressor efficiencies are achieved with minimum vane tip clearances.

The centrifugal air compressor pulley 40 is integrally formed with an internal helical ring gear 130 and are together as one piece referred to as an integral internal helical ring gear/pulley or one-piece input member 132. The input member 132 is supported for rotation on the compressor housing 52 as described in detail later with the ring gear 130 meshing with the pinion gear 72. The grooved compressor pulley 40 has a pitch diameter not less than half that of the engine crankshaft pulley 20 to allow conventional pulley design such that the pitch diameter of the pulley 40 is large enough to avoid belt slip at high speed/load conditions in driving the centrifugal air compressor. In the embodiment illustrated, the pitch diameter of the pulley 40 is half that of the crankshaft pulley 20 and there is thus provided a low overdrive speed ratio (output/input) of 2:1 between the engine crankshaft 18 and the ring gear 130. In the particular engine/centrifugal air compressor combination illustrated, there is required an overdrive speed ratio of 16:1 between the engine crankshaft and the impeller 114. And accordingly, the ring gear 130 is provided with a pitch diameter that is eight times that of the pinion gear to produce a high overdrive speed ratio of 8:1 to factor the series arranged 2:1 overdrive ratio of the belt and pulley drive to the required high mechanical drive train overdrive ratio of 16:1 between the impeller and the engine crankshaft.

The noise resulting from the meshing teeth of the ring gear and pinion gear at the high speeds that they run is maintained at a low acceptable level by the integral formation of the helical ring gear 130 with the pulley 40, and by making this dual function part of molded plastic and preferably of high strength glass fiber reinforced phenolic in a compression molding process. In obtaining this low noise maintenance, both the plastic teeth of the ring gear 130 in their engagement with the steel teeth of the pinion gear 72 and the dampening resulting from the elasticity of the integrally joined plastic ring gear 130 and pulley 40 contribute significantly in reducing the gear noise to an acceptable level not obtainable with metal ring and pinion gears and not obtainable with a plastic ring gear joined to a metal pulley.

The plastic ring gear/pulley 132 is supported on the compressor housing 52 by a steel support shaft 134 having a cylindrical nose 136 of larger diameter received in a blind bore 138 in the flat face 84 of the housing at the front end 54. The support shaft 134 is further formed with a radial flange 140 of relatively large diameter having a ground face 142 at the base of the nose 136 that seats against the flat front housing face 84. The flange is clamped to the housing end face by three bolts 144. This serves to fixedly locate the shaft axially as well as provide a large area or footprint at the interfaces of the flange and the compressor housing for transmitting support shaft loads to the compressor housing.

The plastic ring gear/pulley 132 is molded with a central bore 146 and with counterbores 148 and 150 at the opposite ends of the central bore. The ring gear/pulley 132 is received by and rotatably supported on the support shaft 134 by anti-friction front and rear bearings 152 and 154 of the ball type that are permanently lubricated and sealed. The bearings 152 and 154 are press fitted at their outer race in the respective counterbores 148 and 150 and have a slide fit at their inner race on the support shaft 134. The bearings are press fit into a bearing retainer shell and this assembly is then molded into the ring gear/pulley. The rear bearing 154 seats against a shoulder 156 ground on the shaft 134 at the base of flange 140 and the ring gear/pulley is held in place on the shaft with a preload wave spring 158 and snap ring 160. The bearings 152 and 154 are located so that they are radially aligned with the axial center of the respective pulley 40 and ring gear 130 to carry their load in a balanced manner.

The front end cover 58 encloses both the ring gear 130 and the pinion gear 72 and has an opening for the pulley 40 in which is mounted an elastomeric lip seal 162 that provides sealing between the end cover and the pulley. The lip seal 162 is of slightly larger diameter than the pulley 40 and is received over same on mounting of the end cover. The lip seal 162 sealingly contacts the outer cylindrical surface of a metal seal ring 164 that is integrally molded into the ring gear/pulley 132 between the pulley and ring gear portions 40 and 130. In the installed position of the end cover, the pulley 40 is located outward thereof to receive the drive belt 50. And sealing between the front housing end 54 and the front end cover 58 is provided by an elastomeric O-ring 165.

Super precision mounting of the ring gear 130 with respect to the pinion 72 is provided by making the diameter of the bore 138 that locates the support shaft 134 the same as that of the bore 78 in which the impeller shaft journal bearings are mounted, by tightly tolerancing the bore 138, and by grinding the support shaft nose 136 to closely fit this closely controlled bore. This allows for these two bores to be machined in the same operation with the same tool in the same machine (no tool changing) to very closely control the center distance between these bores and thereby the center distance between the high speed ring gear and pinion gear. The center distance of these gears affects the gear lash and thus noise and by tightly controlling the center distance as described above, the gear lash (noise) is further lowered; i.e. lowered even further than the very significant amount of noise reduction obtained from the plastic ring gear/pulley 132.

The thrust ring 88 has both a minor load carrying face 166 and a major load carrying face 168. During most of its operation, the minor face 166 transfers little or no load into the face 86 machined on the housing 52. The major face 168 carries the bulk of the axial load on the impeller shaft created by air pressure acting on the back of the impeller and which must be borne by the thrust bearing 90 at its bearing face 91. It was found that this load can be reduced very significantly to enhance the life of this bearing and the thrust ring by generating an opposite force on the impeller shaft with the addition of the helical ring and pinion gear to provide mechanical overdrive to the impeller shaft. This is accomplished by setting the lead of the pinion gear 72 in the same direction as the helix of the impeller vanes 116, 117 so that the meshing teeth of the ring and pinion gears as a result of their helix angle produce a pulling or tension force on the impeller shaft in opposition to that produced by the air pressure acting on the back of the impeller. For example, in the compressor illustrated, the air pressure imposed load on the impeller shaft was reduced by about 50% when the helical ring gear and pinion gear were provided with a helix angle of 30° and the pinion gear was provided with a right-hand lead the same as the impeller vanes.

Lubrication in the centrifugal air compressor is provided by oil that is delivered under pressure from the engine's lubrication system via an oil feed line 170 to a fitting 172 threadably connected to the compressor housing 52. A passage 174 connects the fitting 172 to an oil pressure cavity 176 defined by the bore 78 between the journal bearings 80 and 82. The pressurized oil delivered to the cavity 176 is forced out through the clearance in the journal bearings providing lubrication and cooling of the journal bearings as it passes. The oil exiting the front journal bearing 80 impinges on the pinion gear 72 to provide lubrication and cooling of the high speed gears with the oil then draining to a sump 178 formed in the bottom of housing 52. The sump 178 is connected to return oil to the engine lubrication system by a fitting 180 threadably connected to the housing that communicates a drain hole 179 in the sump to an oil return line 182 leading to the engine lubrication system. The oil exiting the rear journal bearing 82 lubricates and cools the minor thrust face 166 of the thrust ring 88 and then drains to the sump 178 for return to the engine lubrication system.

Figure 4:
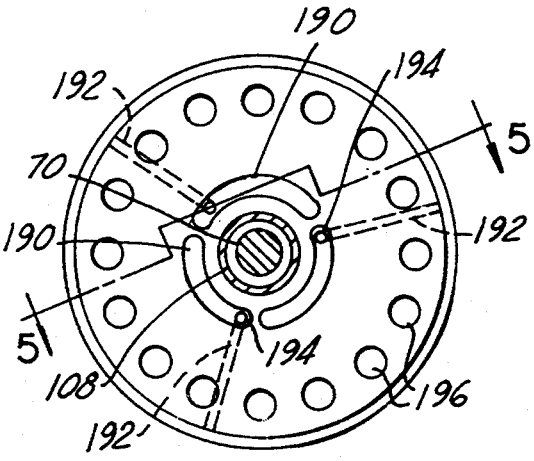
FIG. 4 is an enlarged taken along the line 4—4 in FIG. 2 when looking in the direction of the arrows.
Figure 5:
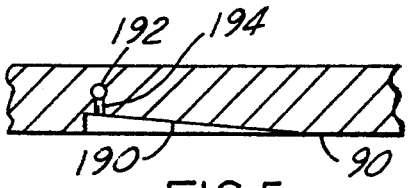
FIG. 5 is an enlarged view taken along the line 5—5 in FIG. 4 when looking in the direction of the arrows.
Figure 2:
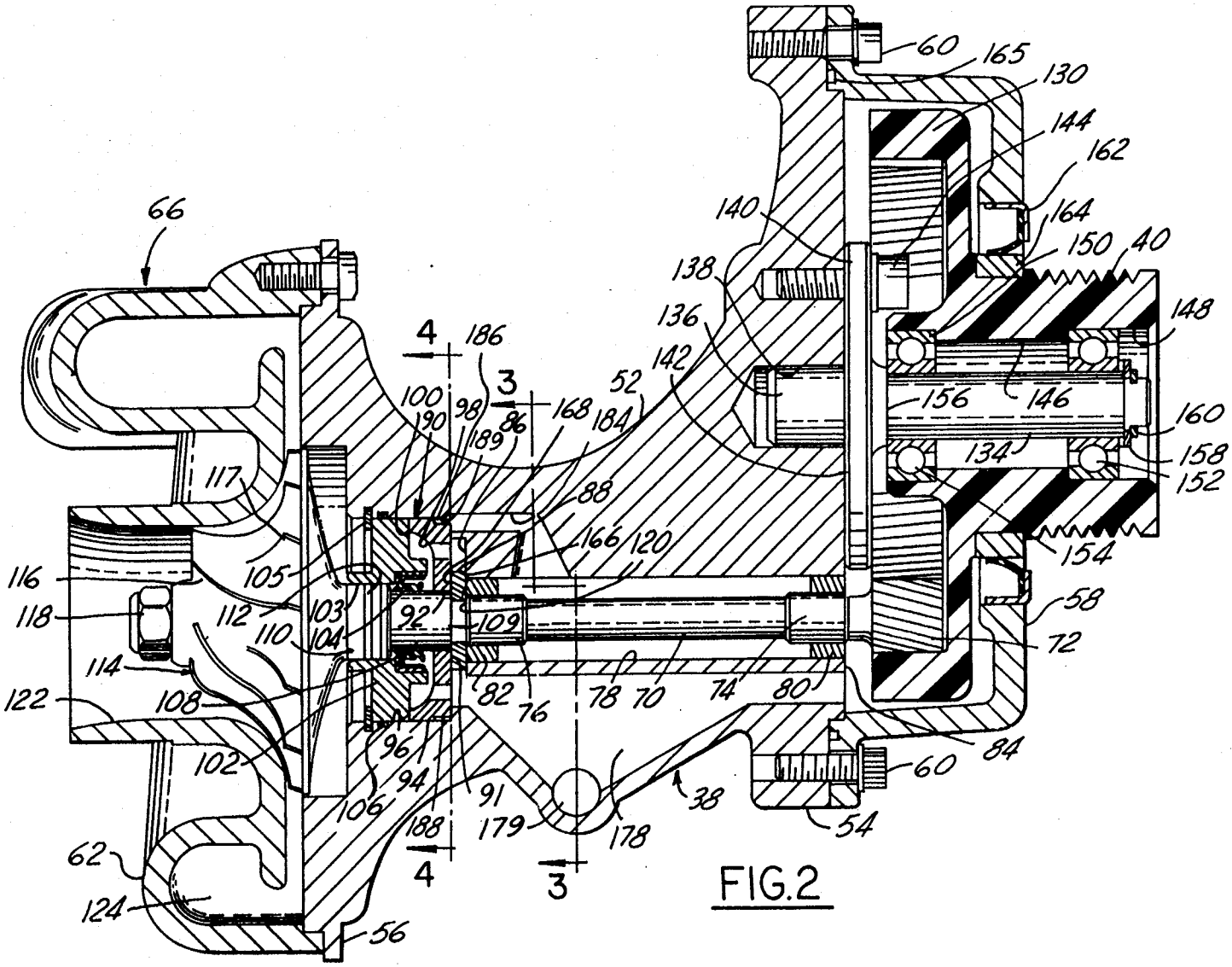
FIG. 2 is an enlarged longitudinal sectional view of the centrifugal compressor in FIG. 1.
Figure 6:
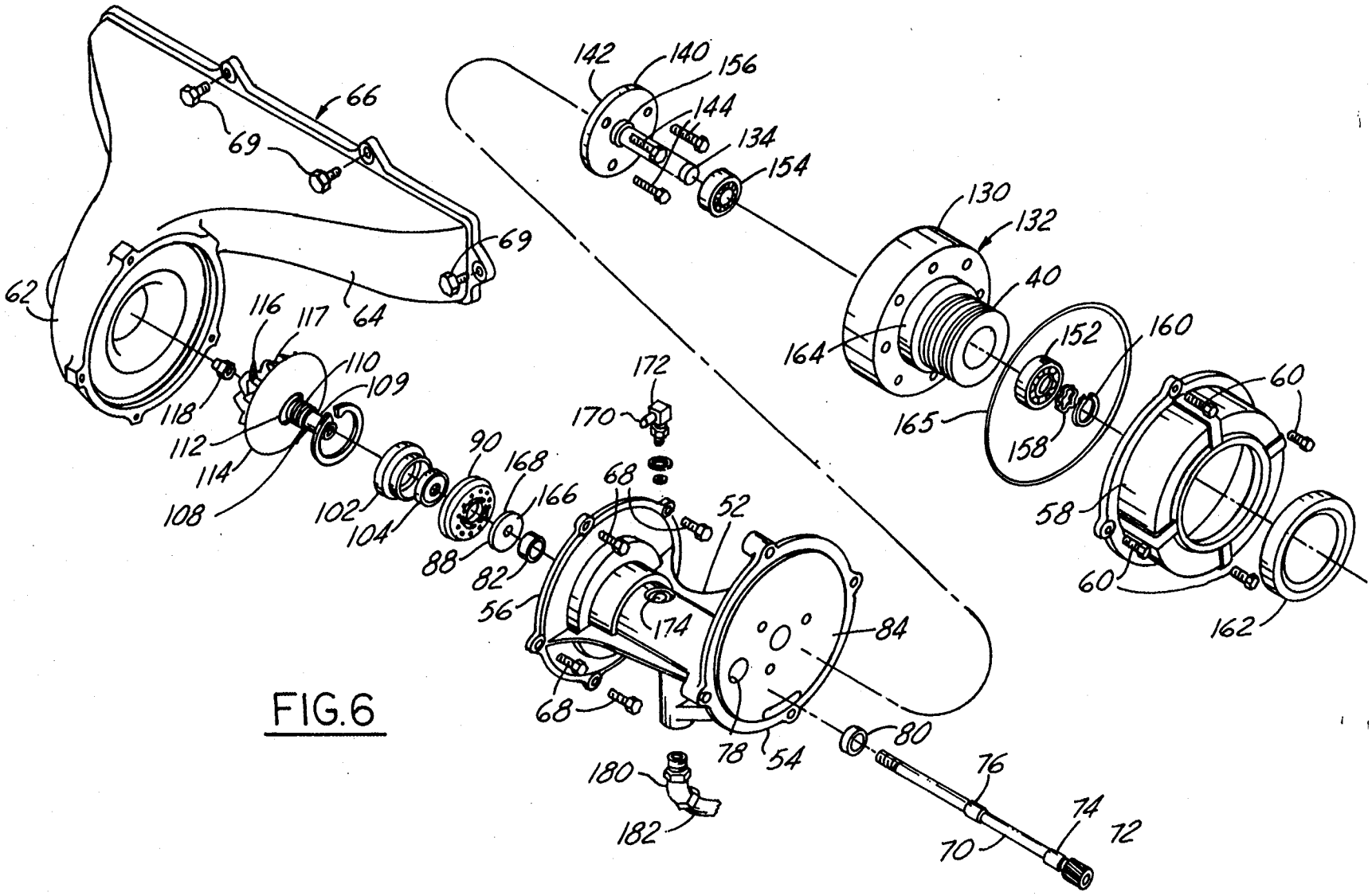
FIG. 6 is an exploded view of the centrifugal air compressor in the above Figures.

Lubrication and cooling of the major thrust face 168 of the thrust ring 88 and the thrust bearing 90 is provided by a passage 184 formed in the housing 52 that connects the pressurized oil cavity 176 between the journal bearings with an annular cavity or channel 186 defined by a stepped shoulder 188 on a corner of the face 91 of the thrust bearing and by the bottom corner 189 of the counterbore 96. The annular cavity 186 is in turn connected to three equally angularly and radially spaced oil pockets 190 formed in the thrust bearing face 91. These connections are made by separate interconnected radial passages 192 and axial passages 194 that are formed in the body of the thrust bearing 90 as illustrated in FIGS. 2, 4 and 5. The oil pockets 190 have an arcuate shape concentric with the impeller shaft and thrust ring axis and a depth that gradually decreases to zero at the thrust bearing face in the direction of impeller shaft rotation as indicated by the arrow in FIG. 4. The radial passages 192 intersect with the annular cavity 186 and with the respective axial passages 194 which in turn intersect with the respective oil pockets 190 at their deep end. The pressurized oil fed to the oil pockets is wiped from their deep end to their terminal end in a wedging action that forms oil pads that transfer the net axial load on the impeller shaft hydrodynamically into the thrust bearing face 91 from the major thrust face 168 of the thrust ring 88. The oil also acts to cool the thrust ring and thrust bearing and on exiting their thrust bearing surfaces drains to the sump 178 along with the oil exiting the rear journal bearing 82 for return to the engine lubrication system. In addition, a plurality of equally angularly and radially spaced axial holes 196 are formed in the thrust bearing 90 to drain oil from the dished side of the thrust bearing and away from the lip seal 104 to the sump 178.

The invention has been described in an illustrative manner with respect to presently preferred embodiments, and it is to be understood that the terminology that has been used is intended to be in the nature of words of description rather than words of limitation. Obviously, many modifications and variations of the present invention in light of the above teachings may be made. It is therefore to be understood that within the scope of the appended claims, the invention may be practiced otherwise than as specifically shown and described.

What is claimed is:

1. A centrifugal air compressor adapted to be mechanically driven by an internal combustion engine and deliver air thereto for combustion, said compressor comprising a housing, an impeller shaft having an impeller with helical vanes at one end and a helical pinion gear at an opposite end, plain journal bearings supporting said impeller shaft at axially spaced locations in said housing, a plastic input member, a support shaft rotatably supporting said plastic input member on said housing in parallel relationship with said impeller shaft, said plastic input member including an integral internal helical ring gear meshing with said helical pinion gear, said plastic input member further including an integral compressor pulley adapted to be driven by the crankshaft of an engine at increased speed by a belt driven by a pulley of larger diameter fixed to the engine crankshaft, a thrust bearing extending about said impeller shaft and mounted in said housing between said impeller and one of said plain journal bearings, a thrust ring mounted on said impeller shaft and sandwiched on one side by a thrust face of said thrust bearing and sandwiched on an opposite side by both said housing and said one plain journal bearing to axially locate said impeller shaft in said housing and wherein air pressure from impeller operation acting on said impeller imposes an axial tension load on said impeller shaft that is borne by said thrust face, and said helical pinion gear and the vanes of said impeller having the same lead so that said internal helical ring gear and helical pinion gear impose a substantial axial tension load on said impeller shaft in opposition to that imposed by air pressure from impeller operation to thereby effect a net axial thrust load borne by said thrust face that is substantially less than that imposed by the air pressure from impeller operation.

2. A centrifugal air compressor as set forth in claim 1 wherein said impeller shaft is a steel impeller shaft and said helical pinion gear is integrally formed with said opposite end of said steel impeller shaft.

3. A centrifugal air compressor as set forth in claim 1 wherein said plastic input member is a glass fiber reinforced phenolic input member.

4. A centrifugal air compressor as set forth in claim 1 wherein said plastic input member is supported on said support shaft with anti-friction bearings.

5. A centrifugal air compressor as set forth in claim 1 wherein said support shaft has a cylindrical nose closely received in a bore in said housing, said journal bearings are press fitted in a bore in said housing having a diameter the same as the bore receiving said cylindrical nose, said support shaft has a flange that interfaces with said housing, and fasteners clamping said flange to said housing to axially locate said support shaft and wherein said flange transmits loads on said support shaft to said housing over a substantial area defined by said flange.

6. A centrifugal air compressor as set forth in claim 1 wherein said plastic input member is supported on said support shaft with a pair of permanently lubricated and sealed ball bearings that are axially spaced and radially aligned with said helical ring gear and pulley.

7. A centrifugal air compressor as set forth in claim 1 wherein said impeller shaft has a shoulder engaging said thrust ring, a seal and spacer sleeve received on said impeller shaft between said impeller and said thrust ring, a fastener threaded to said one end of said impeller shaft pinching said impeller and said seal and spacer sleeve and said thrust ring together with said thrust ring against said shoulder so that said impeller and said seal and spacer sleeve and said thrust ring all rotate with said impeller shaft, a seal retainer mounted in said housing receiving said seal and spacer sleeve, and said seal retainer having a seal engaging a cylindrical outer surface of said seal and spacer sleeve.

8. A centrifugal air compressor as set forth in claim 1 wherein said seal and spacer sleeve has a cylindrical land of larger diameter than said cylindrical surface received in a bore in said seal retainer, said cylindrical land having an annular groove, and a split expansible seal ring received in said annular groove engaging with and held by said bore in said seal retainer.

9. A centrifugal air compressor as set forth in claim 6 wherein said bearings are press fit in a bearing retainer shell to form an assembly, and said assembly is integrally molded into said plastic input member.

* * * * *